US005383685A

United States Patent [19]

Lee

[11] Patent Number: 5,383,685

[45] Date of Patent: Jan. 24, 1995

[54] CHECKING ASSEMBLY WITH PERFORATED GUMMED LABEL HAVING PRE-PRINTED INDICIA THEREON

[76] Inventor: Ling H. Lee, 6496 Heather Dr., Memphis, Tenn. 38119

[21] Appl. No.: 59,307

[22] Filed: May 11, 1993

[51] Int. Cl.[6] ..... B42D 15/00

[52] U.S. Cl. ..... 283/58; 283/81; 283/117

[58] Field of Search ..... 283/57, 58, 59, 70, 283/74, 75, 81, 117; 40/299, 360, 630, 638; 235/2, 3, 17, 379; 229/70, 71, 92.1, 300, 921; D19/11; 462/53, 900

[56] References Cited

U.S. PATENT DOCUMENTS

| | | | |
|---|---|---|---|
| 3,702,924 | 11/1972 | Wood et al. | 283/58 X |
| 3,770,943 | 11/1973 | Sill | 283/58 X |
| 3,790,193 | 2/1974 | McBride | 283/58 X |
| 4,004,058 | 1/1977 | Buros et al. | 283/58 X |
| 4,585,160 | 4/1986 | Fiske, II | 283/58 X |
| 4,634,148 | 1/1987 | Greene | 283/70 |
| 5,121,945 | 6/1992 | Thomson et al. | 283/70 X |
| 5,198,975 | 3/1993 | Baker et al. | 235/379 X |

FOREIGN PATENT DOCUMENTS

| | | | |
|---|---|---|---|
| 2147541 | 5/1985 | United Kingdom | 283/58 |
| 8502148 | 5/1985 | WIPO | 283/58 |

*Primary Examiner*—Peter Dungba Vo

[57] ABSTRACT

To facilitate preparation and processing of checks, this invention discloses a specially designed two-section gummed label to be attached on a bill and to be transferred onto a check. On said gummed label is pre-printed billing and paying readable and scannable information for payment in full or in part. A process utilizing said gummed labels for efficient, postage-saving, labor-saving, and envelope-saving consolidated mass billing and check collection is accomplished by an operating firm collecting periodically billing data from billing firms, printing each of all bills with attached said gummed label, and mailing all bills to each household in one envelope. Each consumer sends appropriately prepared checks in one envelope to said operating firm who speedily and electro-mechanically processes all checks to the credit of respective billing firms.

1 Claim, 1 Drawing Sheet

CHECKING ASSEMBLY WITH PERFORATED GUMMED LABEL HAVING PRE-PRINTED INDICIA THEREON

FIELD OF THE INVENTION

This invention relates to a specially designed gummed label to facilitate preparation and processing of checks and to facilitate efficient consolidated mass billing and check collection process to benefit all concerned parties.

BACKGROUND, PURPOSES, AND BRIEF SUMMARY OF THE INVENTION

Every one of estimated 100 million households and businesses monthly receives multiple separate bills, such as those for local telephone service, long distance telephone service, electricity, water, gas, city services, retail store accounts, and credit card accounts. There are other periodic notices and payments such as insurance, checking accounts, savings accounts, car loans, house mortgage payments, subscriptions, cable T.V., local taxes, brokerage house statements, and mutual fund statements. Under most circumstances, bills are sent periodically by first class mail to each household. Each household then writes and mails a check to each firm along with a payment stub. Labor is required for the payee to manually enter the amount of each check and to to credit the payment to the proper account. Although electronic banking for consumers has been available for a long time, it is rarely used for various reasons, as evidenced by increased number of checks being written. Because of the fact that most of these mailings weigh less than ounce each and because of the postal rate structure (twenty nine cents for the first ounce and twenty three cents for each additional ounce, and lower rates for various presorted mails), an efficient scheme utilizing a specially gummed label is feasible to reduce the cost to all parties by combined mailing of bills and payment checks.

Essential to said scheme is the proposed two-section gummed label attached to each bill, pre-printed with essential readable and scannable data, and to be transferred onto a check, thus reducing the effort and error in preparing checks by consumers. An operating firm periodically collects billing data from billing firms; sorts the data, addresses, and addresses with computers; prints; and mails all bills and notices in one envelope to each household or business. Each addressee mails all checks, in one envelope, with full or partial payments for each account by posting one said gummed labels on each respective check, to said operating firm who sorts and records payments, and delivers all checks to appropriate banks to credit respective billing firms. The purposes and effects of the proposals: (1) reduction of billing and paying postage, (2) reduction of envelope usage, (3) elimination of payment stubs, (4) savings in labor and improved accuracy of check preparation, and (5) savings in labor in check processing by payees, and (6) improved speed and accuracy of check processing by payees.

DESCRIPTION OF THE PREFERRED EMBODIMENT

Figure 1:
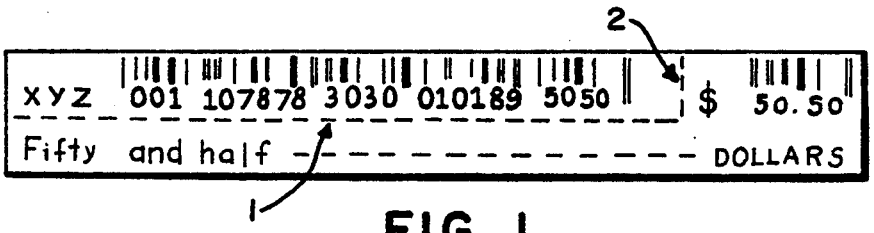
FIG. 1 is a face-on example of the preferred embodiment.
Figure 2:
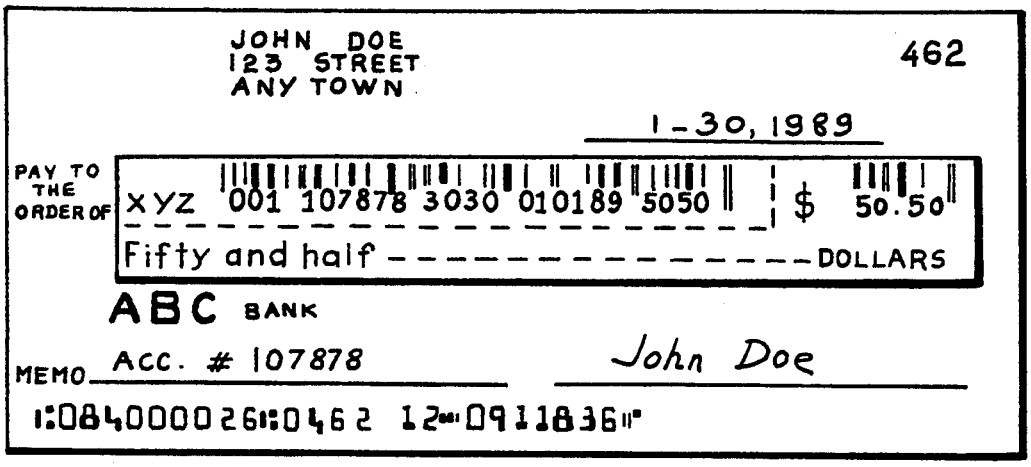
FIG. 2 is completed check on which full payment is executed.
Figure 3:
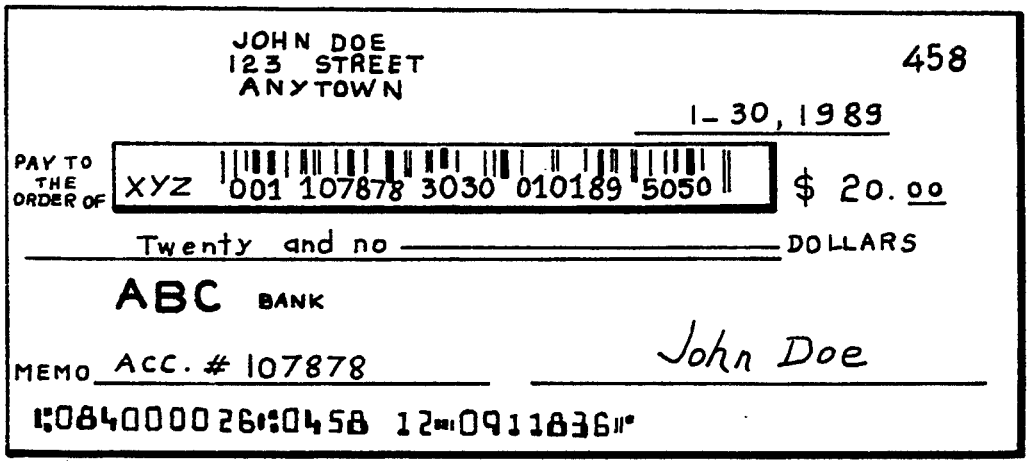
FIG. 3 is a completed check on which a partial payment is executed.

To accomplish above-mentioned purposes and referring to FIG. 1 which is a face-on view of the proposed rectangular gummed label to be attached onto each bill having a horizontal width slightly less than the horizontal width of a standard check, and having a vertical dimension sufficient to accommodate several printed lines. A horizontal perforated line 1 runs across substantially the middle of said gummed label extending from the left of said gummed label to about one inch from the right end of said gummed label thus dividing it into upper segment and a lower segment. On the upper segment is pre-printed in letters the payee followed by readable and optically scannable indica (such as bar codes) identifying the payee (001 for Sears as illustrated), account number (107878 as illustrated), the unpaid balance ($30.30 as illustrated), the date of the bill Jan. 1, 1989 as illustrated), the current amount due $50.50 as illustrated), and any other billing data. A short vertical perforated line 2 is provided extending from the top of said rectangular gummed label to the right end of said horizontal perforated line 1. On the right upper space of said lower segment is pre-printed in Arabic numerals and scannable indicia the current amount due. On the remaining lower space of the lower segment is pre-printed in letters the current amount due. Thus if full payment is executed, the payor transfers the entire gummed label onto his check, dates, and signs it as shown on FIG. 2. For partial payment, he transfers only the upper segment onto his check, and completes the check in usual manner, as shown on FIG. 3. When the operating firm's scanner recognizes the entire label (for example, the amount due $50.50 being recognized twice) the full payment is processed speedily. When the scanner recognizes only the upper segment (for example the amount due $50.50 being recognized only once), the check is ejected for usual processing.

Because of the postal rate structure (twenty nine cents for the first ounce and twenty three cents for each additional ounce, and various incentives in presorted mails), and because most bills and stuffed payment envelopes weigh less than one ounce per unit, an efficient process to consolidate billing and check-based payment is feasible to the benefit of all concerned parties. Billing firms periodically send billing information to an operating firm, who then using computers periodically matches the billing information to each addressee, prints the bills (on a generic form or on billing firms' forms), and mails them in one envelope according to the most advantageous postal rate. The payor, having a choice of paying in full, in part, or not paying at all, prepares a check for each bill utilizing said gummed label as described above, and mails all checks in one envelope to said operating firm. Said operating firm then electro-mechanically processes and sorts the checks accordingly, and immediately delivers them to designated banks for credits of respective billing firms. From the operating firm appropriate reports of transactions are separately delivered to billing firms for their ledgers. The operating firm shall bill payees for the services. Thus, (a) billing postage is reduced, (b) bill-paying postage is markedly reduced. For a ten-bill household per month, the savings comes to $2.61 ($0.29×10−$0.29) per month, (c) tremendous savings in envelopes—two envelopes per month per household versus two envelopes per month per bill, (d) payment stubs are no longer necessary, and (e) because billing firms receive credits much earlier than they do under customary practices, they gain additional overnight interest.

Currently, almost all billing firms take advantage of special presort postal rates by monthly mailing postal zip cycles. Under my proposal, said operating firm likewise can mail combined bills by monthly zip code circles, taking advantage of the special presort rates. Another potential step to further facilitate the final delivery is to print within each zip code progressive even and progressive odd street numbers on envelopes (for each side of the street), and then to deliver all envelopes to the each postal substation directly by said operating firm—the postal service gains advantages by reduction of several handling steps. Thus, for example, in customary month billing cycles, for a city of forty eight postal substations, said operating firm daily only makes two truck stops.

For non-monthly payments and notices, such as subscriptions, tax notices, driver license renewals, and insurance, depending on the addressee's position in the mailing cycle, the operating commits to send them out between one to thirty one days.

The operating firm therefore shall not handle any client's cash.

The format of each bill shall be negotiated between the operating firm and each billing firm, ranging from a generic form to a special designed form. On each bill, some message from the billing firm may be allowed without charge.

With the consent of the consumer, the operating firm may even prepare along with each bill a check with all proper identifications, thus eliminating the consumer's effort of reaching for his check book and saving the cost of about two cents per check.

Confidentiality of billing information shall be guaranteed by said operating firm.

Furthermore, since the weights of stuffed billing envelopes are random, additional advertisement literature may be inserted by said operating firm to a weight just before the next integral ounce is reached. An analysis reveals that, on average, 0.49 ounce of advertisement literature get free ride per billing.

Facsimiles of monthly cancelled checks from banks inexpensively and locally sent via telephone lines to the operating firm incorporated into each billing envelope will reduce operating cost of checking accounts. The original check will be sent only on special occasions and upon specific request from the customer.

My invention resides not in any one of these features per se, rather in the particular combination of them herein disclosed and claimed. Those skilled in the art will appreciate the conception, upon which this disclosure is based, may be utilized as a basis for designing of other structures, methods, and systems for carrying out several purposes of the present invention. It is, therefore, that the claims be regarded as including such construction and obvious derivatives insofar as they do not depart from the scope and the spirit of this invention.

I claim:

1. A checking assembly for improving efficiency of check preparation and check processing, said checking assembly comprising a gummed label, a bill and a standard check, said gummed label attached to said bill, said gummed label subsequently detached from said bill, and then to be posted onto a middle portion of said standard said gummed label comprising:

(a) a rectangular gummed label having a horizontal width slightly less than horizontal width of the standard check and having a vertical dimension sufficient to accommodate several printed lines;

(b) a horizontal perforated line provided across substantially middle of said gummed label extending from left of said gummed label to approximately one inch from right end of said gummed label, thus dividing said gummed label into a upper segment and a lower segment; said upper segment being pre-printed thereon in letters identifying payee followed by readable and optically scannable indicia identifying payee, date of billing, previous balance, account number, current amount due, and other essential billing information; and (c) a short vertical perforated line extending from top of said rectangular gummed label to right end of said horizontal perforated line; a right upper space of said lower segment being pre-printed thereon in Arabic readable numbers and in optically scannable indicia said current amount due, a remaining space of said lower segment being pre-printed thereon in letters identifying said current amount due;

whereby said payor transferring entire said gummed label onto his check for full payment without enclosing the customary payment stub; and thus, payor transferring only said upper segment onto his check for partial payment, then completing said check in usual manner, also without enclosing the customary payment stub; and whereby said payee, according to scanned information on said gummed label, processing said check accurately and speedily.

* * * * *